US006367388B1

(12) United States Patent
Billings

(10) Patent No.: US 6,367,388 B1
(45) Date of Patent: Apr. 9, 2002

(54) AMMUNITION CARTRIDGE WITH DIFFERENTLY PACKED SHOTSHELL WAD PROJECTILE CHAMBERS

(76) Inventor: Chris Lee Billings, 105 Whitesides St., Layton, UT (US) 84041

( * ) Notice: Subject to any disclaimer, the term of this patent is extended or adjusted under 35 U.S.C. 154(b) by 0 days.

(21) Appl. No.: 09/756,164

(22) Filed: Jan. 9, 2001

(51) Int. Cl.[7] ..... F42B 7/04

(52) U.S. Cl. ..... 102/454; 102/453; 102/455; 102/457

(58) Field of Search ..... 102/438, 448–463

(56) References Cited

U.S. PATENT DOCUMENTS

| | | | | |
|---|---|---|---|---|
| 34,806 A | | 3/1862 | Budd | |
| 2,368,029 A | * | 1/1945 | Knight | 102/458 |
| 3,092,026 A | | 6/1963 | Williams et al. | |
| 3,132,588 A | | 5/1964 | Schafer | |
| 3,400,660 A | * | 9/1968 | Malter | 102/459 |
| 3,422,761 A | | 1/1969 | Whitmore | |
| 3,599,568 A | | 8/1971 | Shellnutt | |
| 3,656,433 A | | 4/1972 | Thraikill et al. | |
| 4,760,793 A | * | 8/1988 | Herring, III | 102/460 |
| 4,913,054 A | | 4/1990 | Petersen | |
| 4,996,923 A | | 3/1991 | Theising | |
| D365,867 S | | 1/1996 | Flanagan | |
| 6,202,561 B1 | * | 3/2001 | Head et al. | 102/455 |
| 6,260,484 B1 | | 7/2001 | Billings | |

FOREIGN PATENT DOCUMENTS

| | | |
|---|---|---|
| DE | 2010488 | 6/1983 |
| FR | 1526972 | 11/1968 |
| FR | 2559892 | 8/1985 |

OTHER PUBLICATIONS

Sabot Designs LLC, Advertisement, Long Range Flechette Sabots, Apr. 28, 1998.

* cited by examiner

*Primary Examiner*—Harold J. Tudor
(74) *Attorney, Agent, or Firm*—Dowell & Dowell, P.C.

(57) ABSTRACT

An ammunition cartridge for use with a gun which cartridge has a shotshell wad defining a rear charge receiving chamber and at least two forward shot or other projectile receiving chambers wherein a forward shot receiving chamber is formed of a solid disk including a plurality of shot pellets or similar projectiles embedded in a hardened binder material and wherein a rear shot or similar projectile receiving chamber houses unbound shot pellets or projectiles.

10 Claims, 3 Drawing Sheets

FIG. 1
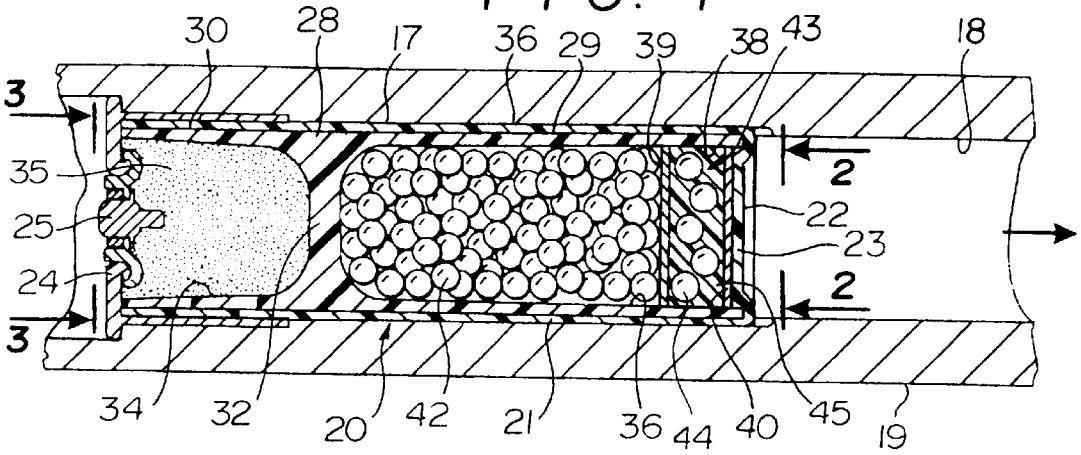
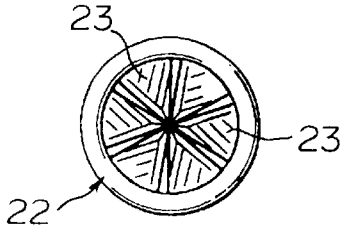
FIG. 2
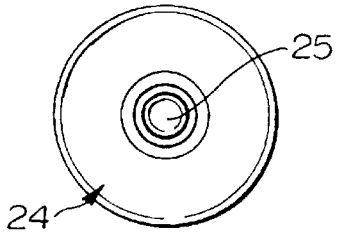
FIG. 3
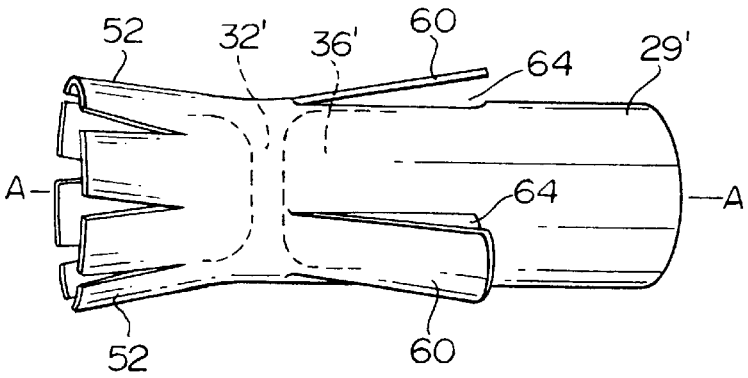
FIG. 8
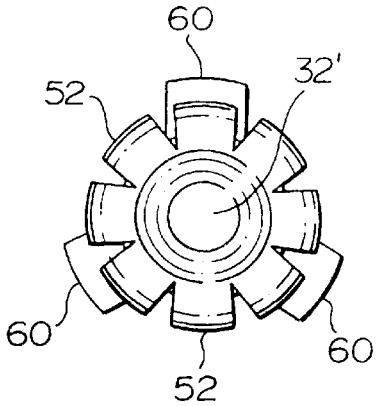
FIG. 9

AMMUNITION CARTRIDGE WITH DIFFERENTLY PACKED SHOTSHELL WAD PROJECTILE CHAMBERS

BACKGROUND OF THE INVENTION

1. Field of the Invention

This invention is directed to ammunition cartridges including shotshell wads wherein the cartridges are of the type used with shot guns and, more specifically, to such cartridges which have a shotshell wad which defines a rear charge receiving chamber and at least two forward shot or other projectile receiving chambers.

2. History of the Related Art

Early ammunition of the type used with shot guns included shell casings in which a plurality of lead shot pellets were housed. Upon firing, the lead shot pellets would exit the barrel of the gun. As lead is a soft metal, the lead shot would not score or damage the interior of the barrel of the gun. However, as the art has progressed, steel pellets are now commonly employed in lieu of lead shot. As steel is a harder material than lead, the steel can score and damage the interior of the bore of the barrel of a gun. In view of this, shotshell wads were developed made of paper and plastic for purposes of housing and carrying the shot forwardly along the interior of the barrel so as to prevent the shot from coming into direct contact with the surface of the bore and, thus, preventing damage to the barrel. When fired, the shotshell wad is designed to carry the load of shot pellets forwardly of the barrel and out of the muzzle area toward a target. Over the years, there have been many improvements made with respect to the design and construction of the shotshell wads in order to affect more control over the type of dispersion of the contained shot pellets and to prevent tumbling of the shotshell wads after exiting the muzzle of a gun after being fired.

In addition to the improvements being made to the shotshell wad casings, there has also been development in the manner in which the shot charges disburse when a cartridge is fired. The degree of spread of the shot pattern can be effected by the manner in which not only the shot is packed, but upon how the surrounding shotshell wad is formed. Generally, when shot pellets are unbound within a conventional shotshell wad, there is a fairly broad pattern obtained upon a cartridge being fired toward a target. Such spreading of the shot pellets reduces the effective point impact of the total shot charge with a target. Therefore, in some shotshell wads, efforts have been made to bind or pack the shot pellets to obtain a more closely packed pattern of shot pellets at the point of impact with a target.

By way of example, in U.S. Pat. No. 3,656,433 to Thraikill et al., flechettes or other small missiles or shot are placed within a viscoelastic matrix, such that when fired, the flechettes, or shot, form a unitary projectile which emerges from a gun barrel until it passes a region at the front end of muzzle of the barrel, afterwhich the flechettes separates, thereby reducing the scattering of the flechettes or other shot. To further control the pattern of missile or shot trajectory until impact with a target, in U.S. Pat. No. 4,913,054 to Peterson, cartridges are disclosed wherein the missiles or shot elements are bound in a friable capsule including a material which becomes rapidly pliable or melts when impacted with a target. Such material may be a polyvinylchloride (PVC) type material. With such a cartridge, the projectile, upon firing, remains substantially intact within the shotshell wad until impact with a target at which time the interior shot or missiles are released, as the surrounding binding material melts or breaks free by the force and the heat developed at impact with the target. Therefore, substantially all the shot or missiles are concentrated at the point of impact.

In view of the foregoing, there remains a need to form cartridges which contain shot pellets or other projectiles wherein the benefits of retaining a compact pattern of pellets until point of impact with the target is achieved but wherein a dispersion of pellets is also obtained so as to diversify the spread of pellets at the point of impact with a target.

Some other examples of prior art patents are disclosed in the U.S. Pat. No. 34,806 to Budd, U.S. Pat. No. 3,092,026 to Williams et al., U.S. Pat. No. 3,132,588 to Schafer, U.S. Pat. No. 3,422,761 to Whitmore, U.S. Pat. No. 3,599,568 Shellmett, and U.S. Pat. No. 4,996,923 to Theising.

SUMMARY OF THE INVENTION

This invention is directed to ammunition cartridges which include a shotshell wad for retaining shot pellets or other projectiles and wherein the shotshell wad includes a rearwardly oriented charge receiving chamber and at least two forwardly oriented shot or other projectile receiving chambers. At least one of the at least two projectile receiving chambers includes projectiles, such as shot pellets, which are unbound with respect to one another, and a forward, of the at least two projectile receiving chambers, is formed as a hardened disk including a plurality of shot pellets or projectiles embedded within a hardened binder material. When the cartridges are fired, the foremost hardened disk will retain the unbound shot pellets generally concentrated within the shotshell wad until impact is made with a target afterwhich, the unbound missiles are permitted to diversify or spread relative to the target.

In a preferred embodiment of the present invention, the hardened disk is formed of a single layer of shot pellets which are embedded within a plastic or adhesive melt. The disk is positioned between dividers within the forward end of a shotshell wad so as to be spaced forwardly of a chamber in which unbound shot pellets are housed, with the unbound shot pellets being separated from the rear charge receiving chamber by an internal partition which is preferably integrally formed with the shotshell wad.

In some embodiments of the invention, the rear portion of the shotshell wad which extends along the charge receiving chamber may include a plurality of wall scores or lines of weakness which extend generally parallel to a longitudinal axis of the shotshell wad. The exterior wall of the shotshell wad along the charge receiving chamber will separate into a plurality of segments which flare radially outwardly upon firing of the shotshell wad from the barrel of a gun, thus facilitating the stability of the flight of the shotshell wad so as to reduce the effect of possible tumbling of the shotshell wad as it moves toward a target.

In other embodiments of the present invention, spaced segments of the rear projectile receiving portion of the shotshell wad may be scored or severed so as to expand outwardly or open in an area adjacent to an internal partition dividing the projectile receiving chambers from the charge receiving chamber so as to thereby reduce pressure within the projectile receiving chamber in which the unbound shot charge is housed. This action will reduce the effect of force packing the shot pellets within the shotshell wad upon firing of a cartridge.

It is a primary object of the present invention to provide an ammunition cartridge for use with guns, such as shot guns, wherein at least two separate projectile receiving chambers are provided within a shotshell wad of the cartridge with a forward of the chambers being formed so as to provide a solid and bound shot pellet structure for providing concentrated impact force with a target and which solid structure retains an unbound charge of shot pellets more concentrated until point of impact with the target afterwhich, the unbound shot pellets disburse in random pattern relative to the target.

It is yet another object of the present invention to provide ammunition cartridges which provide a two-fold impact effect by providing substantial concentrated point impact of a discharged round with a target while also allowing a disbursal of unpacked shot pellets or other projectiles when the round impacts a target.

It is a further object of the present invention to provide ammunition cartridges of the type used for shot guns wherein separate shot dispersions are achieved at the point of impact of a round with a target and wherein the control of the movement of a shotshell wad containing the shot elements is effected by forming the shotshell wad casing so as to control the flight of the shotshell wad and also control internal pressure within the shotshell wad to further enhance dispersion of unbound shot at the point of impact with a target.

BRIEF DESCRIPTION OF THE DRAWINGS

A better understanding of the invention will be had with reference to the attached drawings wherein:

FIG. 1 is a partial cross sectional view showing a first embodiment of cartridge of the invention within a bore of a firearm barrel;

FIG. 2 is a front elevational view taken along line 2—2 of FIG. 1;

FIG. 3 is a rear elevational view taken along line 3—3 of FIG. 1;

FIG. 8 is a side perspective illustrational view showing the expansion of elements of the shotshell wad of FIG. 5 after firing;

FIG. 9 is a rear elevational view of the shotshell wad of FIG. 8;

DESCRIPTION OF THE PREFERRED EMBODIMENT

Figure 4:
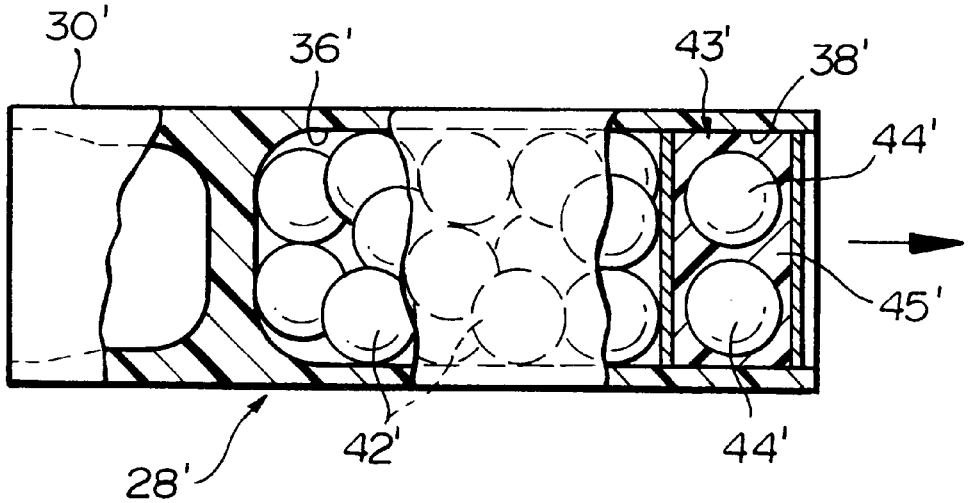
FIG. 4 is a cross sectional view of a second embodiment of shotshell wad for a cartridge in accordance with the invention.

With continued reference to the drawing figures, the ammunition cartridge 20 of the present invention is shown as being mounted with an annular rim seat 17 rearwardly of a bore 18 of a barrel 19 of a firearm. The cartridge includes a cylindrical casing or hull 21 which is closed at its forward end 22 by crimped-end segments 23. The casing 21 is formed of any conventional material, such as a plastic or cardboard. The casing is seated at its rear end within a rim cap 24 which includes a central primer 25.

Mounted interiorly of the casing 21 is a shotshell wad 28 having a forward cylindrical portion 29 and a rearwardly oriented cylindrical portion 30 which are divided by an interior integrally formed partition 32. The shotshell wad is formed of a conventional material such as plastic. The rear portion 30 of the shotshell wad defines a charge receiving chamber 34 in which an explosive charge 35 is retained so as to be ignitable by the primer 25. The forward portion of the shotshell wad defines first and second projectile receiving chambers 36 and 38 which are oriented toward the front end 22 of the cartridge.

The first or rearward projectile receiving chamber 36 extends from adjacent the partition 32 of the shotshell wad forwardly toward a divider 39 which may be formed of a plastic, cardboard or paper material and which separates the first projectile receiving chamber from the second projectile receiving chamber 38. A spaced divider 40 is provide between the second projectile receiving chamber and the front end 22 of the cartridge. As shown in FIG. 1, a plurality of projectiles in the form of metallic shot pellets 42 are mounted within the chamber 36 so as to be unbound with respect to one another. In some embodiments, a separate loose filler material may be introduced into the chamber surrounding the pellets 42, however, this is not preferred. The size and number of pellets may vary depending upon the anticipated use of the cartridge. In this respect, different sizes of shot pellets are shown in FIGS. 4 and 5.

The most forward and second charge receiving chamber 38 is defined by a hardened material disk 43 which is positioned between the dividers 39 and 40. The hardened disk 43 is formed of a plurality of shot pellets 44 which are embedded within a hardened binder material 45. In preferred embodiments, the binder material is formed of a hot melt type plastic or adhesive which completely embeds the shot pellets therein, and which is of a strength to remain intact upon the firing of the cartridge and after the shotshell wad, carrying the hardened disk and the unbound shot pellets exits the muzzle end of the barrel. In this respect, the binder material retains the shot pellets 44 within the hardened disk until impact with a target. Upon impact, the disk may shatter, or partially shatter thereby releasing some, although in many instances, not all, of the shot pellets 43 from the hardened disk.

The hardened disk is positioned forwardly of the unbound shot pellets 42 such that when the shotshell wad 28 exits the barrel of the gun, the unbound shot pellets 42 will be retained behind the disk until impact of the disk with the target. Upon impact, the unbound shot pellets 42 will disburse in a wider pattern about the area of impact of the disk with the target, thus providing a broader coverage of effective impact of the projectiles with the target.

Figure 5:
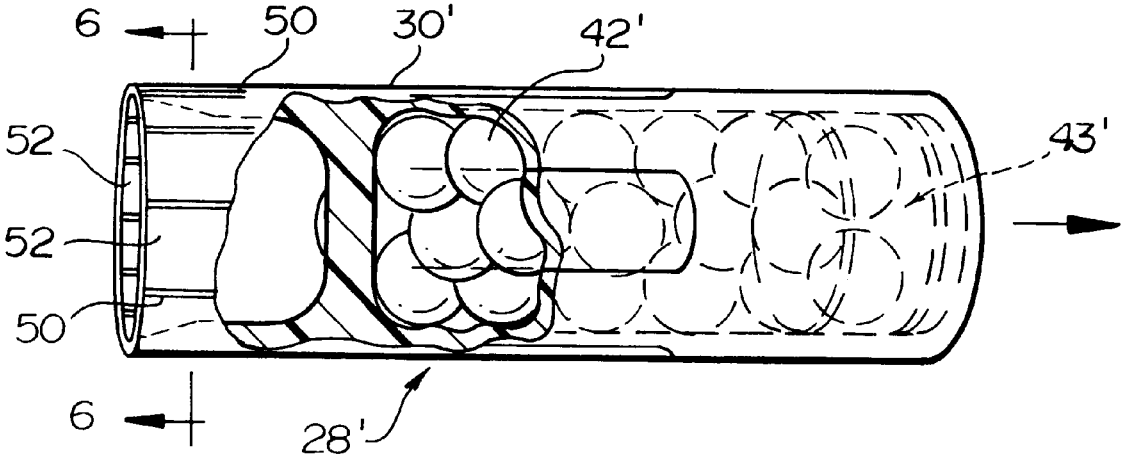
FIG. 5 is a cross sectional view of another embodiment of shotshell wad in accordance with the invention.

With particular reference to FIG. 4, another embodiment is shown in which larger shot pellets are provided in both the first chamber 36 and the forward chamber 38 of the shotshell wad 28'. In this embodiment, the shot 42' is stacked within the chamber 36', and a single layer of shot pellets 44' is provided within the binder matrix of the forward disk 43' within chamber 38'. In the embodiment shown, only two or three pellets 44' are shown as being retained within the binder matrix 45'. Upon firing, the shotshell wad shown in FIG. 4 will function in the same manner as discussed above with respect to the embodiment of FIG. 1.

Figure 6:
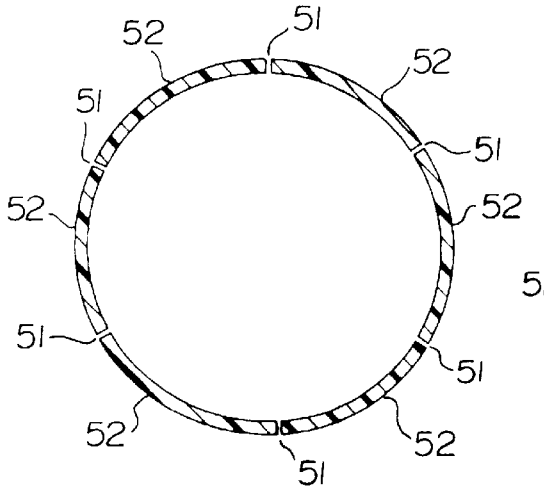
FIG. 6 is an enlarged cross sectional view taken along line 6—6 of FIG. 5 illustrating cut score lines.
Figure 7:
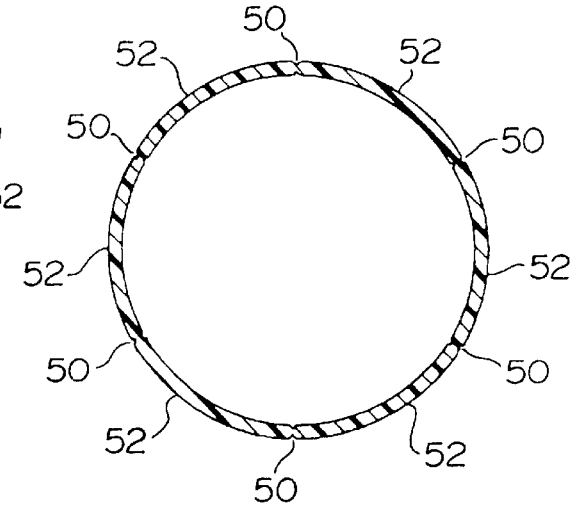
FIG. 7 is an enlarged cross sectional view taken along lines 6—6 of FIG. 5 illustrating non-cut score line.
Figure 10:
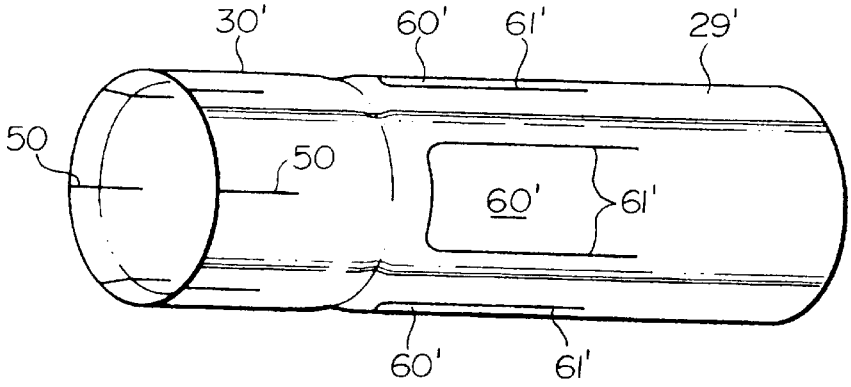
FIG. 10 is a perspective view of a variation of shotshell wad of FIG. 5.
Figure 11:
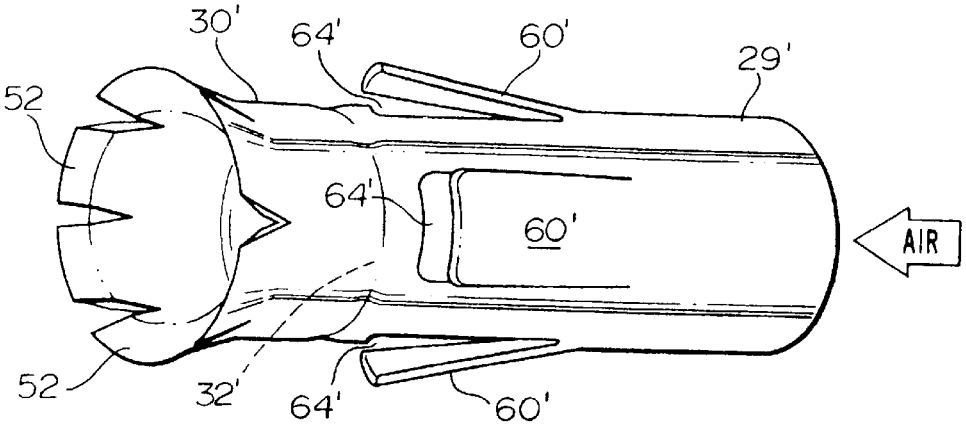
FIG. 11 is a side perspective illustrational view of the shotshell wad of FIG. 10 after firing.

With reference to FIGS. 5–11, to further control and stabilize the flight of the shotshell wad 28' as it exits the muzzle end of the barrel of the firearm, the rear portion 30' of the shotshell wad may have a plurality of longitudinal scores 50, see FIG. 7, or cuts 51, see FIG. 6, provided in the side walls thereof. The side walls are generally equally scored in such a manner that upon ignition of the charge 35 of the cartridge, and upon exiting of the shotshell wad from the barrel, wall segments 52 will become severed relative to one another as shown in FIG. 8, 9 and 11, being extended radially outwardly relative to one another and relative to an elongated axis A—A of the shotshell wad. In this respect, each of the expanded segments 52 will help stabilize the trajectory of the shotshell wad and act to prevent tumbling of the wad as it moves toward a target.

A further benefit of the outwardly extending segments of the rear portion of the shotshell wad is that the segments may be utilized to control the effective flight distance of the wad, thereby limiting the maximum distance that the wad will travel, by causing a deflection of air which will tend to reduce the effective speed of the shotshell wad after being fired.

With specific reference to FIGS. 8–11, the shotshell wad of the present invention may also be provided with a plurality of flap sections 60 or 60' which may be formed by scoring or partially cutting at 62' the walls of the front portion 29 of the shotshell wad. In this respect, the scores form generally U-shaped flaps which sever or open relative to the side walls of the shotshell wad and deflect outwardly upon the shotshell wad exiting the barrel of the firearm. It should be noted that the open areas 64, 64' provided when the flaps flare outwardly as the shotshell wads leave the barrel of a firearm relieve pressure along the innermost portion of the chamber 36'. During normal firing, the shot pellets 42, 42' experience a packing force towards the partition 32, 32'. This force can be relieved by providing a spreading of the side wall or openings such as caused by the flared segments or flaps 60, 60' of the front portion 29' of the shotshell wad. It should further be noted that each of the openings are offset with respect to one another such that they do not align with one another relative to the central axis of the shotshell wad. Thus, opposite each of the openings 64, 64' is a solid wall portion of the shotshell wad, as shown in FIG. 9. Such a structure allows the integrity of the shotshell wad to be maintained while the pressure within the inner projectile chamber 36' is released. Further, the sides of the openings should be of a dimension which is less than the dimension of the shot pellets retained within the chamber 36 of the shotshell wad. It should be noted that the flaps created by segments 60 are connected adjacent the partition 32' while flaps created by the segments 60' are connected spaced from the partition 32', it being of primary importance to allow an expansion of the wads or the openings 64, 64' to be created at least in the area of the partition adjacent the projectile chamber 36' to provide for the relief of pressure within chamber 36'.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A shotshell wad for use with an ammunition cartridge including a generally cylindrical casing having a forward end and rear end which is seated within a rim cap, said shotshell wad being generally cylindrical and mounted within the casing and having a rearward facing charge receiving chamber adapted to be oriented towards the rim cap and at least two forward projectile receiving chambers adapted to be oriented toward the forward end of the casing, said shotshell wad including a partition separating said charge receiving chamber from said at least two projectile receiving chambers, a first of said at least two projectile receiving chambers being adjacent said partition and including a first charge of unbound shot projectiles, and a second of said at least two projectile receiving chambers adapted to be positioned adjacent the forward end of the cartridge casing and being defined by a second charge in the form of a solid disk including a plurality of shot projectiles embedded within a hardened binder material, whereby when a cartridge with the shotshell wad is fired, said first and second shot charges will provide diverse impact effects with an encountered target.

2. The shotshell wad of claim 1 including a divider element provided between said first and second of said at least two projectile receiving chambers.

3. The shotshell wad of claim 2 wherein said partition is integrally formed with said shotshell wad of a plastic material.

4. The shotshell wad of claim 2 wherein said second shot charge is disposed between a pair of space divider elements.

5. The shotshell wad of claim 4 wherein said hardened binder material is selected from a group of materials consisting of plastics and adhesives.

6. The shotshell wad of claim 4 wherein said second charge solid disk includes a single layer of shot pellets embedded in said hardened binder material.

7. The shotshell wad of claim 2 wherein said binder material is selected from a material which will retain said solid disk intact when the cartridge is fired and until impact of said solid disk with a target.

8. The shotshell wad of claim 7 wherein said rearward facing charge receiving chamber is defined by a cylindrical outer wall, a plurality of spaced scores or cuts formed in said outer wall and extending from a rear edge of said shotshell wad forwardly to adjacent said partition, each of said scores or cuts being formed such that said outer wall separates into a plurality of segments along said scores or cuts when said shotshell wad exits from a barrel of a firearm such that said segments extend radially outwardly relative to an elongated axis of said shotshell wad.

9. The shotshell wad of claim 7 in which said forward projectile receiving chambers of said shotshell wad are defined by a forward cylindrical outer wall, a plurality of spaced scores or cuts being provided in said outer wall adjacent said partition, said scores or cuts being formed so as to create openings in said outer wall adjacent said partition when said shotshell wad exits a barrel of a firearm, whereby pressure is relieved in said first of said at least two projectile receiving chambers, as said shotshell wad exits a barrel of a firearm.

10. An ammunition cartridge including a generally cylindrical casing having a forward end and rear end which is seated within a rim cap, a generally cylindrical shotshell wad mounted within said casing and having a rearward facing charge receiving chamber oriented towards said rim cap and at least two forward projectile receiving chambers oriented toward said forward end of said casing, said shotshell wad including a partition separating said charge receiving chamber from said at least two projectile receiving chambers, a first of said at least two projectile receiving chambers being adjacent said partition and including a first charge of unbound projectiles, and a second of said at least two projectile receiving chambers being positioned adjacent said forward end of said casing and being defined by a second charge in the form of a solid disk including a plurality of projectiles embedded within a hardened binder material, whereby when the cartridge is fired, said first and second charges will provide diverse impact effects with an encountered target.

* * * * *